United States Patent [19]

Brandt

[11] Patent Number: 4,619,584

[45] Date of Patent: Oct. 28, 1986

[54] DOUBLE PROPELLER DRIVE FOR BOATS

[75] Inventor: Lennart Brandt, Fjärås, Sweden

[73] Assignee: AB Volvo Penta, Gothenburg, Sweden

[21] Appl. No.: 576,150

[22] Filed: Feb. 2, 1984

Related U.S. Application Data

[63] Continuation of Ser. No. 354,769, Mar. 4, 1982, abandoned.

[30] Foreign Application Priority Data

Mar. 5, 1981 [SE] Sweden ..... 8101423

[51] Int. Cl.[4] ..... B63H 5/10

[52] U.S. Cl. ..... 416/129; 416/200 R; 416/201 A

[58] Field of Search ..... 416/124, 125, 128, 129, 416/200 R, 201 A, 120, 127, 130; 440/80, 81

[56] References Cited

U.S. PATENT DOCUMENTS

| | | | |
|---|---|---|---|
| 537,612 | 4/1895 | Leathers | 416/129 |
| 599,125 | 2/1898 | Fefel | 416/129 |
| 968,823 | 8/1910 | Westinghouse | 416/201 A X |
| 1,224,120 | 4/1917 | Cake | 416/124 |
| 1,717,663 | 6/1929 | Checkley | 416/201 A |
| 1,853,694 | 4/1932 | Melcher | 416/129 |
| 2,672,115 | 3/1954 | Conover | 416/129 |
| 3,356,150 | 12/1967 | Ruszczycky et al. | 416/129 X |
| 3,396,800 | 8/1968 | Hillander et al. | 416/129 X |

FOREIGN PATENT DOCUMENTS

| | | | |
|---|---|---|---|
| 528957 | 11/1921 | France | 416/124 |
| 882081 | 5/1943 | France | 416/129 |

*Primary Examiner*—Everette A. Powell, Jr.
*Attorney, Agent, or Firm*—Arthur G. Yeager

[57] ABSTRACT

A boat propeller drive with double, counter-rotating propellers is distinguished by the after propeller having one more blade than the fore propeller as well as a smaller diameter than the fore propeller.

17 Claims, 4 Drawing Figures

DOUBLE PROPELLER DRIVE FOR BOATS

This application is a continuation of application Ser. No. 354,769, filed Mar. 4, 1982 now abandoned.

The present invention relates to a double propeller drive for boats with a first propeller shaft which supports a first propeller, and a second propeller shaft mounted concentrically with the first shaft and which carries a second propeller, said shafts being drivably coupled for rotation in opposite directions.

Double-mounted propellers of the type described above can be used for high-power transmission when it is desirable to keep the propeller diameter small both for reasons of space and to reduce the mass forces and stresses on the transmission. In known double propeller drives, two propellers have been used with the same diameter and the same number of blades, the only essential difference being that one propeller had right-hand pitch and the other left-hand pitch. This did not take into consideration, however, the fact that the after propeller works under different operating conditions than the fore propeller, since it works in the slip stream of the latter. The result is less than optimum efficiency for the after propeller.

The purpose of the present invention is generally to achieve a double propeller arrangement of the type described in the introduction which is designed taking into account the differencies in the operating conditions of the propellers to optimize the efficiency of both propellers.

This is achieved according to the invention by making the after propeller of smaller diameter than the fore propeller and with at least one more blade than the fore propeller. In a preferred embodiment of the propeller drive according to the invention, the fore propeller has three blades and the after propeller four blades.

The fore and after propellers together create a flow tube of fluid which passes the fore propeller. By using, in accordance with the invention, an after propeller with a smaller diameter than the fore propeller, one can be sure that it will lie well within the flow tube and extinguish eddies created by the blade ends of the fore propeller. Providing the after propeller with one more blade than the fore propeller is based on the insight that a propeller with four blades, for example, has a smaller optimum diameter than one with three blades, so that for a given power and r.p.m., an optimum propeller is provided despite the smaller diameter. This also takes into account the fact that the after propeller affects the fore propeller by drawing water from it.

The invention provides a propeller drive with double propellers in which the propellers provide almost equal thrust. So that the propellers will have the same cavitation limits, they are made with approximately the same total blade area. In practice, this means that the diameter of the after propeller should be about 85–95% of the diameter of the fore propeller and its blade width about 75–85% of the blade width of the fore propeller. In addition, the after propeller blade pitch should be up to 10% greater than the blade pitch of the fore propeller and its pitch maximum should be placed at a propeller radius which is up to 10% greater than the radius for the pitch maximum of the fore propeller, to thereby reduce the risk of pressure side cavitation.

Especially for so-called inboard-outboard drives with inclined steering shafts, the propeller shafts in a preferred embodiment are coupled for driving the fore propeller counter-clockwise and the after propeller clockwise. In inboard-outboard drives with inclined steering shafts, the external moments acting on the outboard leg, which are added to the engine torque and the reaction moment acting on the propeller from the water, have components acting along the steering shaft. Since combustion engines usually have clockwise rotating shafts, the torque components cooperate with clockwise rotating propellers, which results in a greater steering moment. In counter-clockwise rotating propellers, the moments counteract each other and produce a low steering moment. This condition is accentuated further by the transverse force which the propeller is subjected to when it strives to "climb" in the water, due to the fact that the propeller blades close to the water surface produce less force than the deeper blades.

The design according to the invention is based on the fact that the fore propeller, in acceleration or sharp curves, for example, can give cavitation bubbles to the after propeller, which is then no longer working in "clean" water and therefore absorbs lower torque with subsequent lower thrust. When the drive system is thus dominated under certain operating conditions by the fore propeller, it is an advantage for the reasons given above if it rotates counter-clockwise.

The invention will be described below with reference to an embodiment shown on the accompanying drawings.

Figure 1:
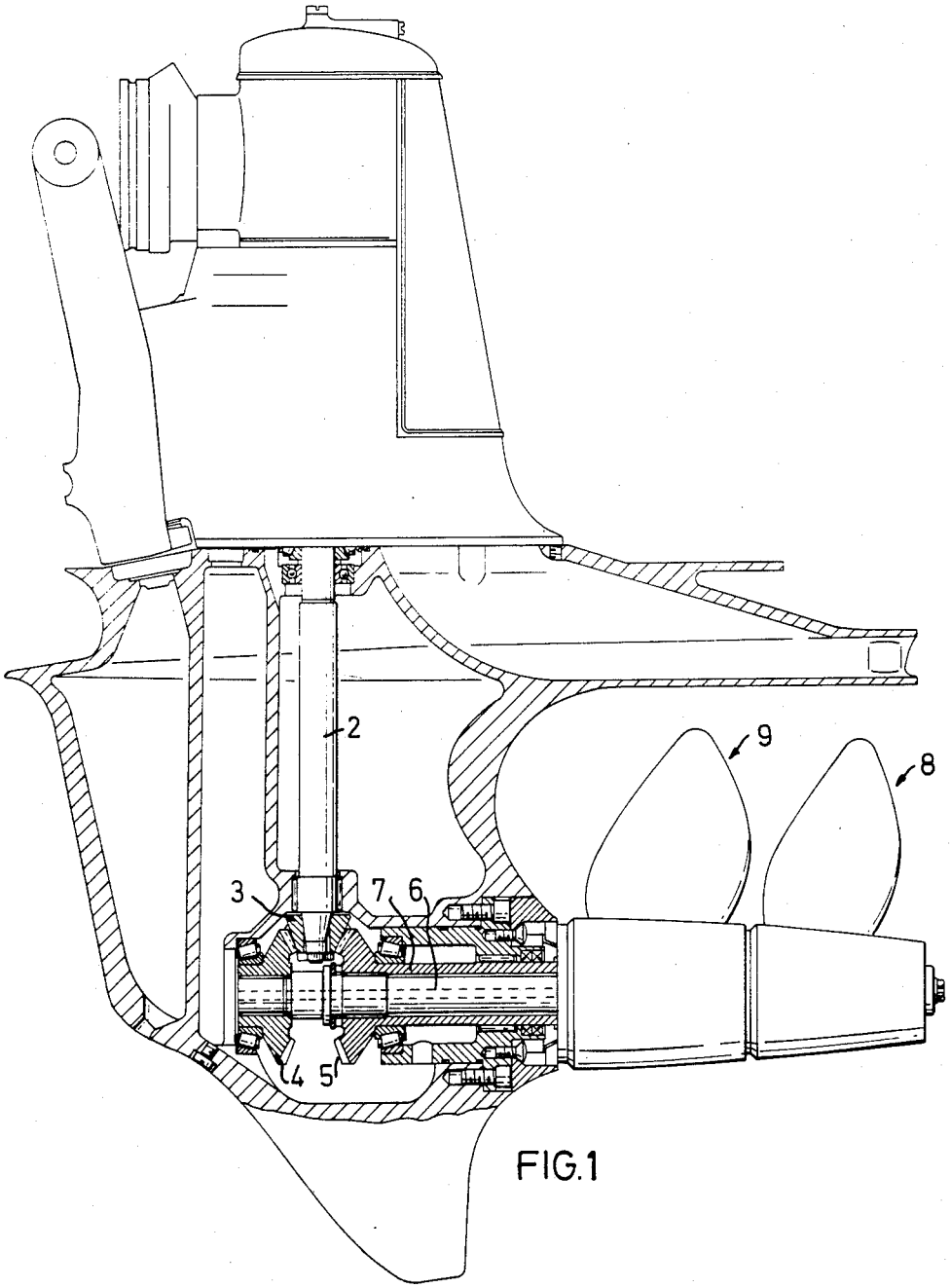
FIG. 1 shows a partially cut-away side view of a double propeller drive according to the invention.

The propeller drive generally designated 1 in FIG. 1 is a so-called inboard-outboard drive, designed to be mounted on the transom of a boat and to be connected to the output shaft of a motor (not shown). The drive contains a reversing mechanism which has a driving shaft 2 having a conical gear 3 in constant engagement with two conical gears 4 and 5. The gear 4 drives a propeller shaft 6 and the gear 5 drives a propeller shaft 7 in the form of a hollow shaft mounted concentrically to the shaft 6. The shaft 6 carries a propeller 8 and the shaft 7 a propeller 9. With the arrangement described, the propeller shafts will rotate in opposite directions, with the rotational direction of the shaft 2 being selected so that the shaft 7 rotates counter-clockwise as seen from the rear.

Figure 2:
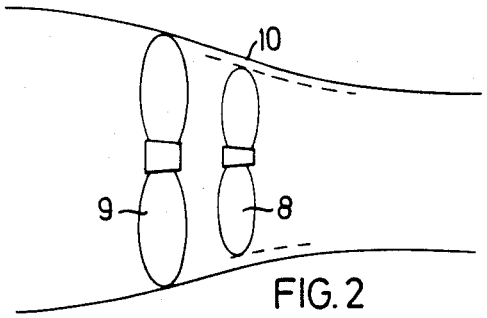
FIG. 2 is a schematic view illustrating the flow tube generated by the propellers.

According to the invention, the fore propeller 9 has a greater diameter than the after propeller 8, so that the latter will lie well within the flow tube 10 created by the propellers, as schematically illustrated in FIG. 2, so that the after propeller 8 is not disturbed by the eddies formed by the blade tips of the fore propeller 9. In the embodiment shown in FIG. 1, the diameter of the after propeller 8 is 95% of the diameter of the fore propeller, but depending on various factors such as load level for example, the diameter of the after propeller can be 85–95% of the diameter of the fore propeller.

Figure 3:
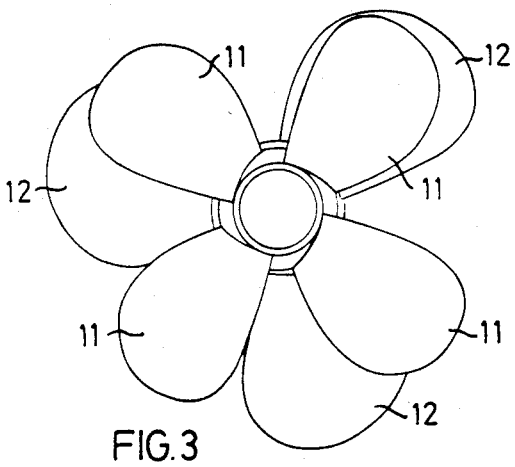
FIGS. 3 and 4 are a planar view and a perspective view of the fore and after propellers.
Figure 4:
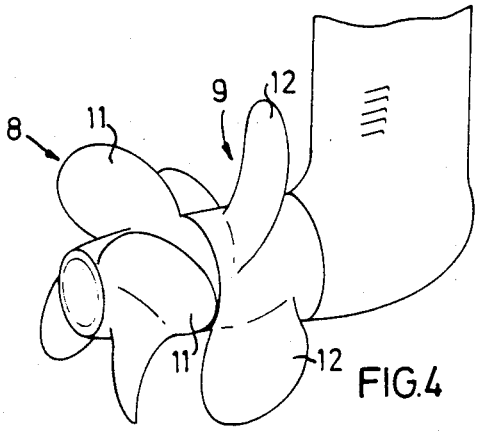

As can be seen from FIGS. 3 and 4, the after propeller has four blades 11, while the fore propeller has three blades 12. The blade width of the after propeller can vary between about 75% and 85% of the blade width of the fore propeller and, in the embodiment shown, the blade width of the after propeller is about 75% of the blade width of the fore propeller. The after propeller can hve the same or up to 10% greater pitch than the fore propeller, and its pitch maximum can lie at the same or up to 10% greater radius than the pitch maximum of the fore propeller.

In order to eliminate the risk of having a damaged propeller replaced by a propeller which does not fulfill the above requirements concerning adaption to the other propeller, it is suitable to provide each propeller with some form of marking, stating which propeller it is to be combined with. A simple method of achieving this is to mark matching propellers with the same color, e.g. by painting a colored band around the hub.

What I claim is:

1. In a steerable double propeller outboard drive unit for a boat having a transom and means mounting said unit on said transom for steering said unit about a generally upright steering axis, said unit including a first propeller having a plurality of blades, a first propeller shaft drivingly connected to said first propeller, and a second propeller having a plurality of blades, a second propeller shaft mounted concentrically with said first shaft and drivingly connected to said second propeller, power means including a substantially vertical output drive shaft coupled to said first and second shafts for rotation of said first and second propellers in opposite directions, the improvement comprising the after propeller of said first and second propellers being of a predetermined diameter smaller than the diameter of the fore propeller, and said after propeller including at least one blade more than said fore propeller so that said first and second propellers provide approximately equal thrust to minimize the reaction steering moments on said unit.

2. In the unit according to claim 1 wherein said fore propeller has three blades and said after propeller has four blades.

3. In the unit according to claim 2 wherein said after propeller is 85–95% of the diameter of said fore propeller and its blade width is 75–85% of the blade width of said fore propeller.

4. In the unit according to claim 3 wherein the pitch of said after propeller is the same as or up to 10% greater than the pitch of said fore propeller, and the pitch maximum of said after propeller having a propeller radius which is the same as or up to 10% greater than the radius of the pitch maximum of said fore propeller.

5. In the unit according to claim 4 including means wherein said fore propeller is rotated counter-clockwise and said after propeller is rotated clockwise.

6. In the unit according to claim 1 wherein said after propeller is 85–95% of the diameter of said fore propeller and its blade width is 75–85% of the blade width of said fore propeller.

7. In the unit according to claim 6 wherein the pitch of said after propeller is equal to or up to 10% greater than the pitch of said fore propeller, and the pitch maximum of said after propeller having a propeller radius which is equal to or up to 10% greater than the radius of the pitch maximum of said fore propeller.

8. In the unit according to claim 1 wherein the pitch of said after propeller is the same as or up to 10% greater than the pitch of said fore propeller, and the pitch maximum of said after propeller having a propeller radius which is the same as or up to 10% greater than the radius of the pitch maximum of said propeller.

9. In the unit according to claim 2 wherein the pitch of said after propeller is equal to or up to 10% greater than the pitch of said fore propeller, and the pitch maximum of said after propeller having a propeller radius which is equal to or up to 10% greater than the radius of the pitch maximum of said fore propeller.

10. In a steerable double propeller outboard drive unit for a boat having a transom and means mounting said unit on said transom for steering said unit about a generally upright steering axis, said unit comprising a pair of propeller shafts drivingly connected to a propeller driving means, said propeller shafts being concentrically mounted and being drivable in opposite directions, a fore and an after propeller respectively having a plurality of blades mounted on said propeller shafts for rotation of said propellers in said opposite direction, the improvement wherein said after propeller is of a predetermined diameter smaller than the diameter of said fore propeller and said after propeller includes at least one more blade than said fore propeller so that each of said propellers provide approximately equal thrust to minimize the reaction steering moments on said unit.

11. In the unit according to claim 10 wherein said fore propeller includes three blades and the said after propeller includes four blades.

12. In the unit according to claim 11 wherein the diameter of said after propeller is 85–95% of the diameter of said fore propeller and the blade width of said after propeller is 75–85% of the blade width of said fore propeller.

13. In the unit according to claim 12 wherein the pitch of said after propeller is the same as or up to 10% higher than the pitch of said fore propeller, and the pitch maximum of said after propeller having a propeller radius which the same or as up to 10% greater than the radius of the pitch maximum of said fore propeller.

14. In the unit according to claim 10 wherein the diameter of said propeller is 85–95% of the diameter of said fore propeller and the blade width of said after propeller is 75–85% of the blade width of said fore propeller.

15. In the unit according to claim 14 wherein the pitch of said after propeller is equal to or up to 10% higher than the pitch of said fore propeller, and the pitch maximum of said after propeller having a propeller radius which is equal to or up to 10% greater than the radius of the pitch maximum of said fore propeller.

16. In the unit according to claim 10 wherein the pitch of said after propeller is the same as or up to 10% higher than the pitch of said fore propeller, and the pitch maximum of said after propeller having a propeller radius which is the same as or up to 10% greater than the radius of the pitch maximum of said fore propeller.

17. In the unit according to claim 11 wherein the pitch of said after propeller is the same as or up to 10% higher than the pitch of said fore propeller, and the pitch maximum of said after propeller having a propeller radius which is the same as or up to 10% greater than the radius of the pitch maximum of said fore propeller.

* * * * *

US004619584B1

REEXAMINATION CERTIFICATE (1929th)

United States Patent [19]

Brandt

[11] B1 4,619,584

[45] Certificate Issued Feb. 23, 1993

[54] DOUBLE PROPELLER DRIVE FOR BOATS

[75] Inventor: Lennart Brandt, Fjärås, Sweden

[73] Assignee: AB Volvo Penta, Gothenburg, Sweden

Reexamination Request:
No. 90/001,984, Apr. 6, 1990

Reexamination Certificate for:

| | |
|---|---|
| Patent No.: | **4,619,584** |
| Issued: | **Oct. 28, 1986** |
| Appl. No.: | **576,150** |
| Filed: | **Feb. 2, 1984** |

Related U.S. Application Data

[63] Continuation of Ser. No. 354,769, Mar. 4, 1982, abandoned.

[30] Foreign Application Priority Data

Mar. 5, 1981 [SE] Sweden ..... 8101423

[51] Int. Cl.[5] ..... B63H 5/10

[52] U.S. Cl. ..... 416/129; 416/200 R; 416/201 A

[58] Field of Search ..... 416/124, 125, 128, 129, 416/200 R, 201 A, 120, 127, 130; 440/80, 81

[56] References Cited

U.S. PATENT DOCUMENTS

| | | | |
|---|---|---|---|
| 2,064,195 | 12/1936 | De Michelis | 416/129 |
| 3,537,419 | 11/1970 | Holtermann et al. | 115/34 |
| 3,688,732 | 9/1972 | Singelmann et al. | 115/37 |
| 3,697,193 | 10/1972 | Phillips | 416/223 |
| 3,765,370 | 10/1973 | Shimanckas | 115/35 |
| 3,769,930 | 11/1973 | Pinkerton | 115/35 |
| 3,817,202 | 6/1974 | Holtermann | 115/34 |
| 4,052,952 | 10/1977 | Hale et al. | 115/41 |
| 4,073,601 | 2/1978 | Kress | 416/242 |
| 4,074,652 | 2/1978 | Jackson | 115/35 |
| 4,178,873 | 12/1979 | Bankstahl | 115/73 |
| 4,297,097 | 10/1981 | Kiekhaefer | 440/59 |
| 4,352,666 | 10/1982 | Mcgowan | 440/53 |
| 4,529,387 | 7/1985 | Brandt | 440/66 |
| 4,552,511 | 11/1985 | Sumigawa | 416/242 |
| 4,619,584 | 10/1986 | Brandt | 416/129 |
| 4,642,059 | 2/1987 | Nohara | 440/75 |

FOREIGN PATENT DOCUMENTS

| | | |
|---|---|---|
| 323677 | 1/1930 | United Kingdom . |
| 314968 | 5/1930 | United Kingdom . |
| 857394 | 12/1960 | United Kingdom . |
| 886169 | 1/1962 | United Kingdom . |
| 1203560 | 8/1970 | United Kingdom . |
| 1216291 | 12/1970 | United Kingdom . |
| 1324799 | 7/1973 | United Kingdom . |
| 1514298 | 6/1978 | United Kingdom . |
| 2094894 | 9/1982 | United Kingdom . |

OTHER PUBLICATIONS

"Systematic Studies of Contra-Rotating Propellers for Merchant Ships", Eric Bjarne, *Proceedings: International Marine and Shipping Conference* organized by the Institute of Marine Engineers and held in London, Jun. 4–8, 1973.

*Primary Examiner*—John T. Kwon

[57] ABSTRACT

A boat propeller drive with double, counter-rotating propellers is distinguished by the after propeller having one more blade than the fore propeller as well as a smaller diameter than the fore propeller.

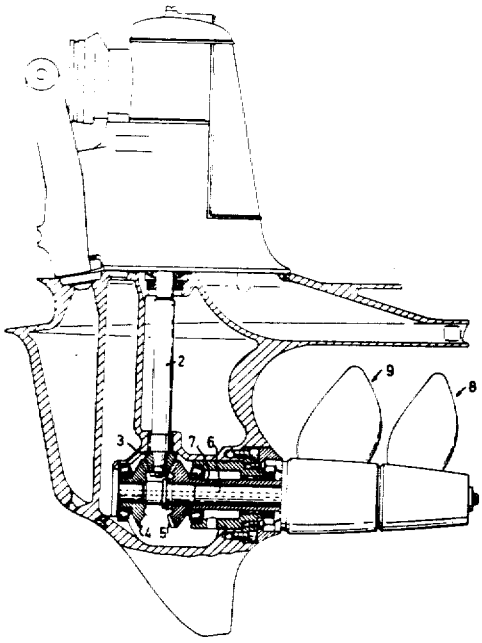

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 10–17 is confirmed.

Claim 1 is determined to be patentable as amended.

Claims 2–9, dependent on an amended claim, are determined to be patentable.

New claims 18 and 19 are added and determined to be patentable.

1. In a steerable double propeller outboard drive unit for a boat having a transom, *an engine having an output shaft rotating in a predetermined direction,* and means mounting said unit on said transom for steering said unit about a generally upright steering axis, said unit including a first propeller having a plurality of blades, a first propeller shaft drivingly connected to said first propeller, and a second propeller having a plurality of blades, a second propeller shaft mounted concentrically with said first shaft and drivingly connected to said second propeller, power means including a substantially vertical output drive shaft coupled to said first and second shafts for rotation of said first and second propellers in opposite directions, the improvement comprising the after propeller of said first and second propellers being of a perdetermined diameter smaller than the diameter of the fore propeller, [and] said after propeller including at least one blade more than said fore propeller so that said first and second propellers provide approximately equal thrust to minimize the reaction steering moments on said unit, *and said after propeller rotating in the same direction as the engine output shaft.*

*18. The unit according to claim 1, further comprising a marking provided on each propeller, the marking indicating which other propeller the propeller can be combined with.*

*19. A steerable double propeller outboard drive unit for a boat having a transom, an engine having an output shaft rotating in a predetermined direction, and means mounting said unit on said transom for steering said unit about an inclined steering axis, said unit comprising:*

*a forward propeller having a plurality of blades;*

*a first propeller shaft drivingly connected to said forward propeller;*

*an after propeller having a plurality of blades, said after propeller being of a predetermined diameter smaller than the diameter of the forward propeller and including at least one blade more than said forward propeller;*

*a second propeller shaft mounted concentrically with said first shaft and drivingly connected to said after propeller; and*

*power means including a substantially vertical output drive shaft coupled to said first and second shafts for rotation of said forward and after propellers in opposite directions,*

*said forward and after propellers providing approximately equal thrust and said after propeller rotating in the same direction as the engine output shaft.*

* * * * *